United States Patent [19]

Graham

[11] Patent Number: 4,984,138

[45] Date of Patent: Jan. 8, 1991

[54] CONSOLE COLOR DISPLAY

[76] Inventor: Gary R. Graham, 9375 SW. Parkview Loop, Beaverton, Oreg. 97005

[21] Appl. No.: 438,608

[22] Filed: Nov. 16, 1989

[51] Int. Cl.[5] ..... F21V 33/00

[52] U.S. Cl. ..... 362/85; 362/295

[58] Field of Search ..... 362/85, 295; 340/815.1, 340/815.12

[56] References Cited

U.S. PATENT DOCUMENTS

| | | | |
|---|---|---|---|
| 1,945,635 | 2/1934 | Greenewalt | 362/293 |
| 2,561,885 | 7/1951 | Prideaux et al. | 40/130 |
| 3,585,503 | 2/1952 | Schulze | 177/311 |
| 3,602,769 | 8/1971 | Tuzar | 315/211 |
| 4,257,084 | 3/1981 | Reynolds | 362/31 |
| 4,392,187 | 7/1983 | Bornhorst | 362/85 X |
| 4,575,660 | 3/1986 | Zaharchuk et al. | 315/295 |
| 4,648,690 | 3/1987 | Ohe | 350/321 |
| 4,727,296 | 2/1988 | Zaharchuk et al. | 315/295 |
| 4,729,067 | 3/1988 | Ohe | 362/26 |
| 4,843,527 | 6/1989 | Britt | 362/231 |

*Primary Examiner*—Allen M. Ostrager

*Attorney, Agent, or Firm*—Klarquist, Sparkman, Campbell, Leigh & Whinston

[57] ABSTRACT

A display for a stage lighting control console provides colored display elements adjacent light control devices of the console. Each colored display element corresponds in color to the color of a stage light associated with the adjacent light control device. The colored display elements are replaceable or remountable whereby the display accommodates different stage lighting configurations by rearrangement or substitution of the colored display elements.

14 Claims, 5 Drawing Sheets

CONSOLE COLOR DISPLAY

The present invention relates generally to stage lighting and particularly to color indicia for stage lighting control consoles.

BACKGROUND OF THE INVENTION

In a typical stage lighting control system a lighting control console is located with a view toward the stage and different colored stage lights illuminate the stage. The control console includes individual light control devices, or faders, for operation of corresponding stage lights. The operator thereby illuminates the stage in selected light colors to achieve a desired stage lighting effect.

For a given stage arrangement, each stage light is directed toward a portion of the stage and a color filter, or gel, is mounted to provide a desired lighting color. The stage lights are operatively connected to the control console and each fader controls one or more associated stage lights. The operator associates each fader with a given colored stage light by notation written on adhesive tape lying next to the fader. Thus, various color names are written across the adhesive tape in accordance with the current stage arrangement.

During a stage performance the operator provides a variety of lighting scenes in coordination with the stage performance, and this can be challenging. Lighting control consoles can have as many as ninety faders in each bank. There are over two hundred standard stage light gels colors, and additional colors are possible by overlaying gels. Also, with slight variations between similar colors, it is difficult to distinguish, by crowded written notion on adhesive tape, subtle differences between similar colors. To provide a given lighting scene a particular combination of fader settings is needed; the operator must read the adhesive tape notation to identify stage lights requiring adjustment and adjust the corresponding faders. In many cases scenes change rapidly. The operator must quickly identify and adjust the faders to preserve coordination with the stage performance.

Given experience with a particular stage arrangement and performance, an operator of the lighting control console becomes adept at manipulating the faders to move from scene to scene. However, performances and lighting arrangements change. The fader labels on the adhesive tape are often rewritten. Even experienced operators are faced with new fader labels. Also, experienced operators are not always available. It is therefore desirable that the operator be able to quickly and reliably associate faders with the stage lights, despite unfamiliarity with the current stage arrangement.

Some stage lighting control consoles are programmable. A particular combination of fader settings, a lighting scene, is stored by first setting the faders as desired and then invoking an automatic procedure which reads the fader settings and writes corresponding values into a memory device. A number of scenes can be loaded into the console for later recall during a stage performance. Even a programmable lighting control console requires that the user label the faders by notation on adhesive tape for a given stage arrangement and step through each scene to be presented during the performance. Efficient use of a programmable lighting control console requires the operator to quickly identify and adjust the faders to move from scene to scene during programming.

SUMMARY OF THE INVENTION

It is therefore an object of the present invention to provide a method and apparatus for quickly and reliably adjusting a lighting control console. Operators unfamiliar with a given stage arrangement can more quickly master new fader assignments.

It is a further object of the present invention to provide an accurate indication of the stage light color associated with a given fader. The operator thereby distinguishes between subtle color differences.

The foregoing objects and advantageous are achieved by a lighting control console having display elements corresponding in color to the color of the stage light controlled by an adjacent fader. The operator need not read crowded notation on adhesive tape, stage light colors associated with each fader are determined precisely by quick inspection.

According to one aspect of the present invention, the colored console display elements include a light source and gels of the same or similar material as used on the corresponding stage lights. The light provided by each display element is very close in color to the light provided by the corresponding stage light. This enables the operator to easily distinguish subtle color differences.

In a second aspect of the present invention, the colored display elements are replaceable. The lighting control console is thereby easily re-configured for each new stage arrangement.

In one embodiment of the present invention, a lighting control console display includes colored display elements integral to the console and adjacent corresponding faders. Each colored display element includes a light source varying in intensity with the intensity of the corresponding stage light, and a gel similar to that on the corresponding stage light. As the operator adjusts the faders, the corresponding display elements provide both color and intensity information.

In a second embodiment of the present invention, a lighting control console display includes a light conductive element adapted to receive a light source. The display is positioned adjacent the faders with gel strips mounted to the light conductive element. The gel strips correspond in color to the associated stage light, and correspond in position to the faders. When the light source is activated, light carried by the light conductive element passes through the gel strips and provides the desired color indica. This embodiment may be incorporated into a preexisting lighting control console by adaptation to common console light sources.

The subject matter of the present invention is particularly pointed out and distinctly claimed in the concluding portion of this specification. Both the organization and method of operation of the invention, together with further advantages and objects thereof, however, may best be understood by reference to the following description and accompanying drawings wherein like reference characters refer to like elements.

DETAILED DESCRIPTION OF THE INVENTION

Figure 1:
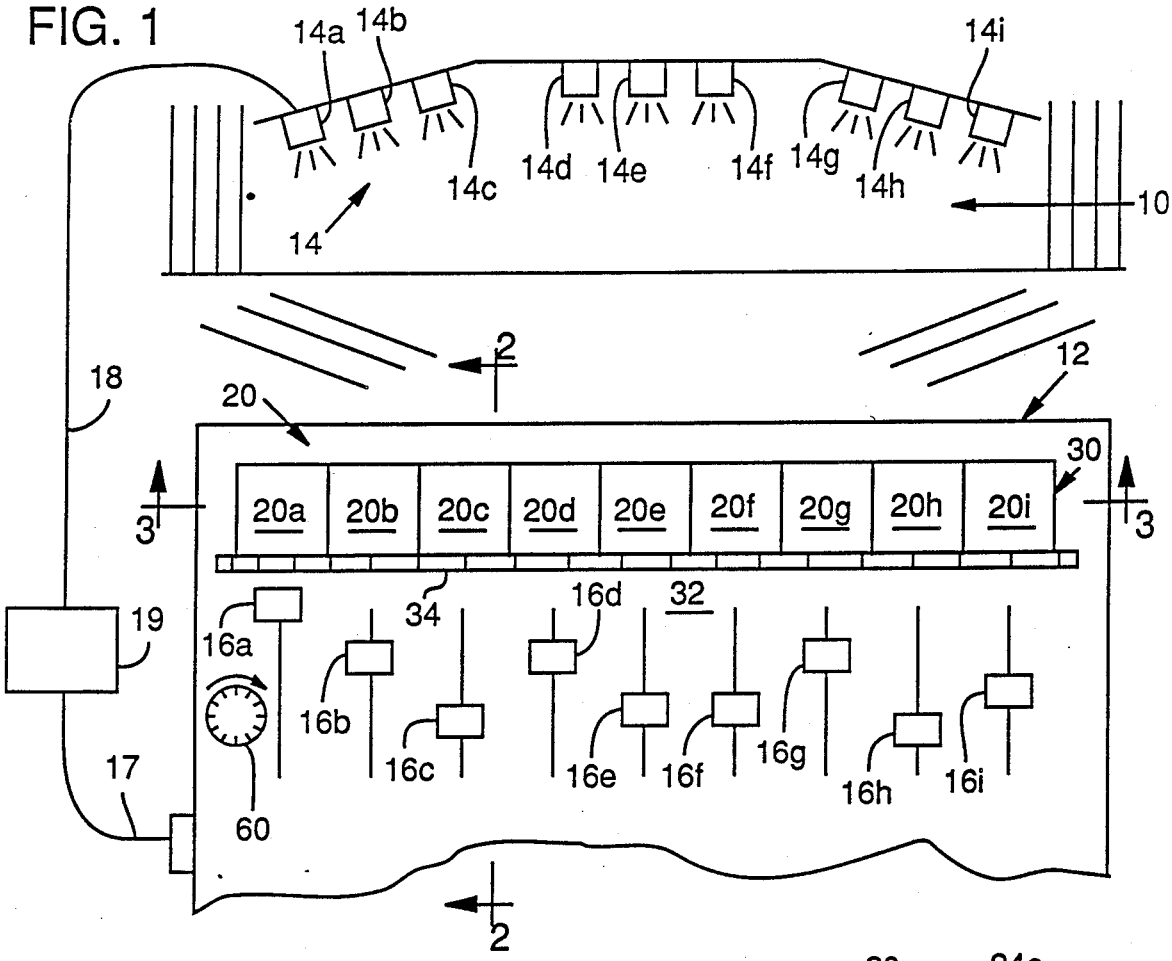
FIG. 1 illustrates a stage lighting system including a lighting control console with an integrated color display according to the present invention.

FIG. 1 illustrates a stage lighting control system having a lighting control console 12 located with a view toward a stage 10. Colored stage lights 14, individually numbered 14*a*–14*i*, illuminate stage 10. A multi-stand cable 17 connects console 12 to a dimmer pack 19 for applying control signals thereto. Dimmer pack 19 connects by way of multi-stand cable 18 to stage lights 14 for applying power to stage lights 14 in accordance with control signals received from console 12. An operator of console 12 manipulates stage lights 14 in coordination with a stage performance. Console 12 includes individual light control devices or faders 16, individually numbered 16*a*–16*i*, for operation of corresponding stage lights 14*a*–14*i*. For example, as fader 16*a* is moved toward stage 10 the intensity of stage light 14*a* increases, and as fader 16*a* is moved away from stage 10 the intensity of stage light 14*a* decreases. It will be understood that for any given stage arrangement the lights 14 may be positioned in any arbitrary pattern and the corresponding faders 16 would not necessarily correspond in position to the position of stage lights 14. Accordingly, it is necessary for an operator of console 12 to be able to associate a given fader 16 with the corresponding stage light 14.

Console 12 includes a display 20 having colored display elements, individually numbered 20*a*–20*i*, adjacent corresponding faders 16*a*–16*i*. Each display element 20 corresponds in color to that of the stage light controlled by the adjacent fader 16. The operator of console 12 thereby quickly determines the color of the stage light controlled by each fader 16.

Figure 2:
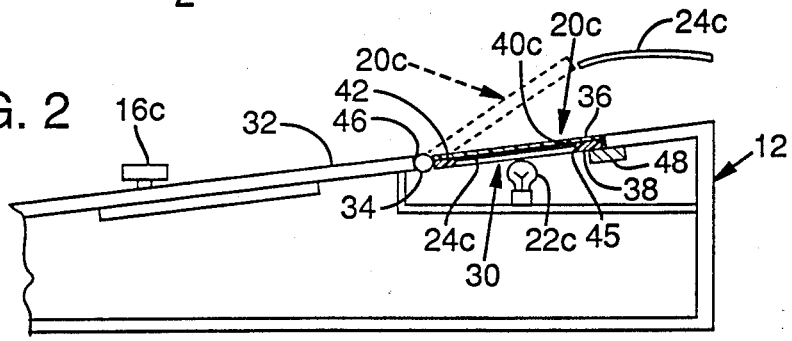
FIG. 2 is a cross sectional view of the lighting control console of FIG. 2 taken along lines 2—2 of FIG. 1.

With reference to FIG. 2 in conjunction with FIG. 1, each display element 20 includes a light source 22 and a gel strip 24. FIG. 2 illustrates in cross section the display element 20*c* including the source 22*c* and the gel strip 24*c*, however, it will be understood that display elements 20 are each similar to element 20*c* as shown. As will be described in greater detail hereafter, each light source 22 is operatively coupled to the corresponding fader 16 whereby operation of each fader 16 causes variation in intensity of both the stage light 14 controlled by the fader 16 and the corresponding light source 22. The gel strips 24 are cut from the same or similar material as used on the corresponding stage light 14, i.e., the stage light controlled by the adjacent fader 16. Thus, light emitted by each display element 20 is very close in color to the light emitted by the corresponding stage light 14.

The display 20 includes a frame 30 attached to the face 32 of console 12 by a hinge 34. A protective plastic or glass panel 36 mounts to frame 30 and serves as the top surface of display 20. Gel strips 24 mount behind panel 36 in spaced relation corresponding to the spaced relation of faders 16. Gel strips 24 so mounted to frame 30 are positioned adjacent corresponding faders 16. Placing the hinge 34 at the lower edge of frame 30, i.e., closest to the operator, shields the operator from the unfiltered glare of light sources 22 when frame 30 is pivoted to its open position as shown in phantom in FIG. 2. With frame 30 in its open position, the gel strips 24 are removable and remountable on frame 30. Thus, display 20 is easily re-configured for a new stage arrangement by re-arrangement or replacement of gels 24.

Figure 3:
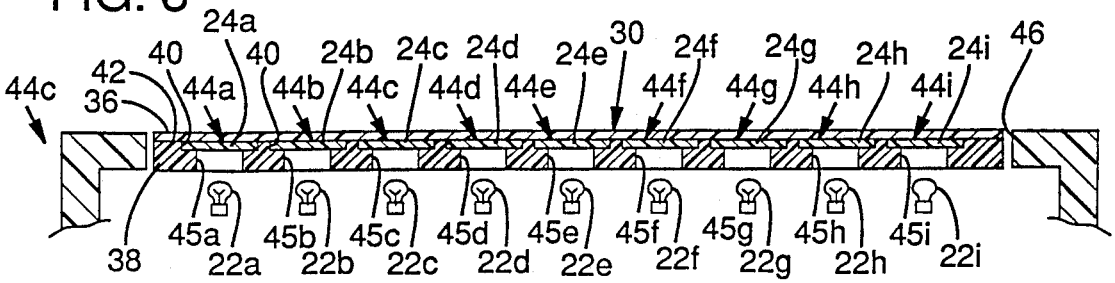
FIG. 3 is a cross sectional view, taken along lines 3—3 of FIG. 1, showing mechanical details of the display of FIG. 1.

With reference to FIG. 3, showing frame 30 in cross section, frame 30 includes an aluminum base plate 38 with an upper surface 42. Rectangular recesses cut into the base plate 38 from the upper surface 42 are defined by recess walls 40. Panel 36 is bonded to upper surface 42 leaving gel strip retention spaces 44, individually numbered 44*a*–44*i*, as defined by panel 36 and recess walls 40 of base plate 38. Retention spaces 44*a*–44*i* correspond in position to the associated faders 16*a*–16*i*, respectively. A gel strip 24, having dimensions corresponding to a retention space 44, may then be positioned adjacent each fader 16. Base plate 38 is provided with view apertures 45*a*–45*i* located intermediate of corresponding light sources 22*a*–22*i* and retention spaces 44*a*–44*i*, respectively. Thus, light emitted by sources 22 passes through the corresponding view apertures 45 and gels 24. Each display element 20 thereby provides light corresponding in color to the color of the gel 24 mounted in the corresponding retention space 44.

Base plate 38 is attached to hinge 34 whereby the frame 30, including mounted gel strips 24, pivots as shown in FIG. 2. Hinge 34 and frame 30 pivot into an opening 46 in console 12 with a stop 48 (FIG. 2) positioned to hold the upper surface of panel 36 flush with the upper surface of console 12. This mounting arrangement retains each gel strip 24 within the corresponding retention space 44 while the frame 30 is closed, and allows removal of gel strips 24 when frame 30 is opened.

Figure 4:
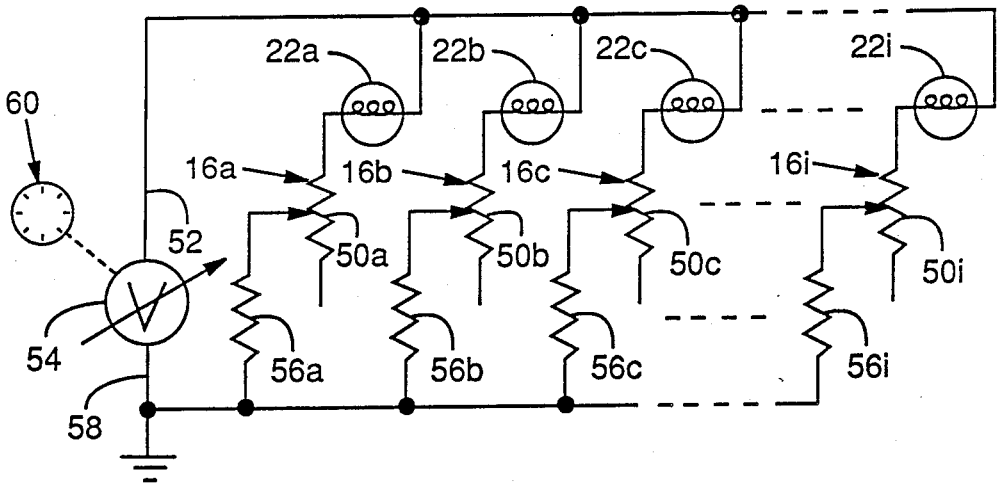
FIG. 4 is a diagram of a control circuit for the display of FIG. 1.

FIG. 4 illustrates a control circuit for display 20. The light source 22 of each display element 20 is connected in series with a corresponding potentiometer 50, individually numbered 50*a*–50*i*. A first terminal of each light source 22 connects to the positive lead 52 of a variable voltage source 54. The second terminal of each light source 22*a*–22*i* connects to the stationary terminal of the corresponding potentiometer 50*a*–50*i*, respectively. The movable terminal of each potentiometer 50 connects, through a corresponding limiting resister 56*a*–56*i*, respectively, to the negative or common terminal 58 of voltage source 54. Thus, potentiometers 50 individually control the intensity of the corresponding light sources 22.

A dimmer control knob 60 (FIGS. 1 and 4) determines the output of variable voltage source 54. By suitably selecting component values and the voltage range of source 54, knob 60 may be used to raise the output of power supply 54 to bias the control circuit and provide a minimum output for light sources 22. Thus, even when a potentiometer 50 is positioned to turn off the associated stage light, the corresponding display element 20 will be illuminated. The operator is then able to determine stage light colors even when the stage light is off. Also, by adjustment of knob 60 the output of source 54 may be lowered to eliminate the minimum output of light sources 22. In such condition, only light sources 22 corresponding to currently activated stage lights 14 are illuminated. In either case, intensity variation of each light source 22 corresponds to intensity variation of the corresponding stage light 14.

To accomplish the primary function of controlling stage lights 14, console 12 would include circuit elements (not shown) for producing and applying stage light control signals to dimmer pack 19. Such circuit elements might include a second set of potentiometers corresponding to potentiometers 50*a*–50*i*, each physically coupled to the corresponding potentiometer 50 for movement therewith. The second set of potentiometer would control the intensity of corresponding stage lights 14 whereby variations in intensity of stage lights 14 would be matched by variations in intensity of light sources 22. Alternatively, a high input impedance device, such as the gate of a transistor, could be attached at the interconnection of each light source 22 and the corresponding potentiometer 50. Such transistors could then be used in a circuit to control the intensity of the stage lights. However, it would be necessary to account for variations in the voltage source 54 directed toward biasing of the display control circuit shown on FIG. 3. In any event, the incorporation of a display device having individual light sources varying in intensity with the intensity of the corresponding stage light may take many conventional forms, all of which are considered within the scope of the present invention.

Figure 5:
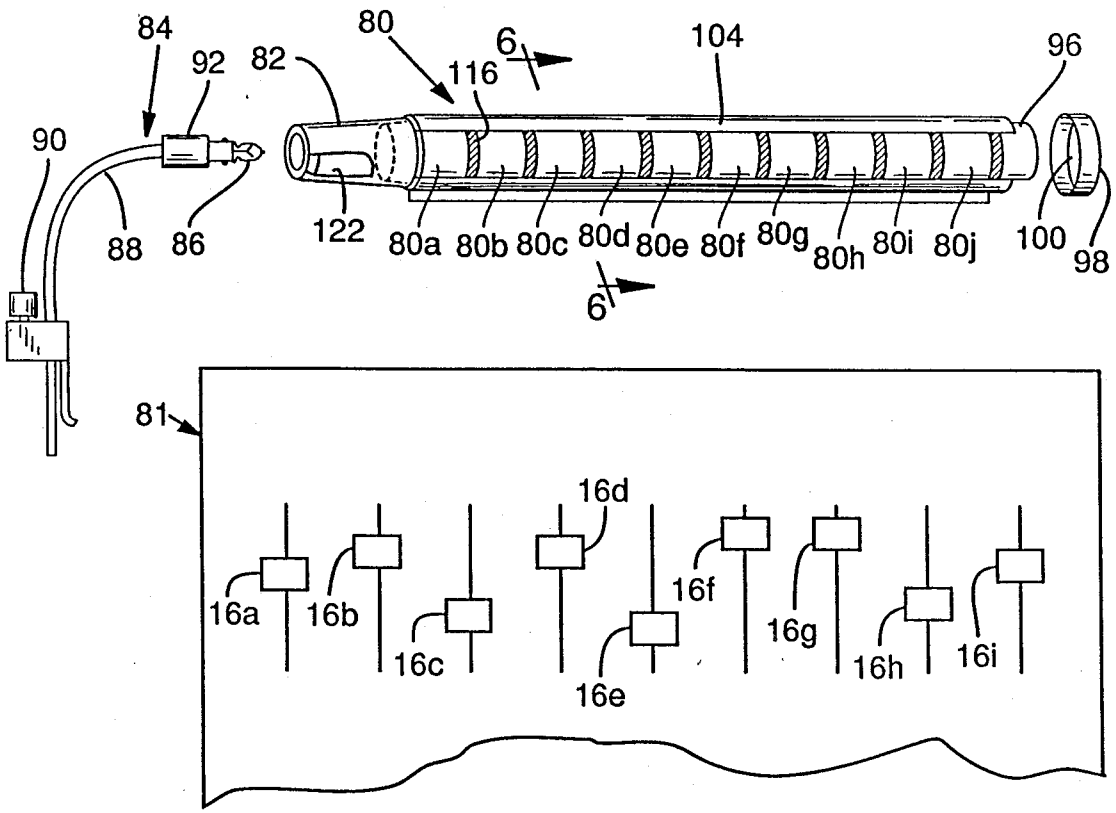
FIG. 5 illustrates a second color display according to the present invention adapted for use in with preexisting lighting control consoles.

FIG. 5 illustrates a second embodiment of the present invention adapted for use in conjunction with preexisting lighting control consoles. In FIG. 5, a display 80 includes colored display elements, individually numbered 80*a*–80*i*. The display elements 80*a*–80*i* correspond in color to the stage lights 14*a*–14*i* and in position to the faders 16*a*–16*i* of console 81. Thus, the display 80 may be placed on the surface of console 81 adjacent faders 16 with each display element 80*a*–80*i* positioned adjacent a corresponding fader 16*a*–16*i*, respectively. An operator of console 81 is then able to quickly associate each fader 16 with a corresponding stage light 14 by quick inspection of display 80.

Display 80 includes a shield 82 adapted to couple to a light source 84. Light source 84 may be a preexisting light source of console 81, or may be incorporated into the display 80 in conventional fashion. A common preexisting light source 84 found on many lighting control consoles includes a light source 86 mounted on the distal end of a flexible support 88. The light source 84 includes a dimmer knob 90 for controlling the intensity of light source 86. Light source 84 also includes a mounting structure 92 upon which the light source 86 mounts. Shield 82 is adapted to couple to the structure 92 in order to receive the light source 86 therein. Thus, display 80 is adapted to couple to a preexisting light source of a lighting control console.

Display 80 also includes an acrylic rod 96 serving as a light conducting element. Shield 82 mounts to an end of rod 96 whereby light emitted from source 86 enters that end of rod 96 and is carried along the length of rod 96. A cap 98 mounts to the opposite end of rod 96 and includes a reflective surface 100 abutting the end face of rod 96. Thus light entering rod 96 from source 86 travels along the length of rod 96 and reflects at the distal end of rod 96. It has been found that by polishing the ends of rod 96 more light enters rod 96 from source 86 and more light reflects back into rod 96 at surface 100.

A semi-tubular, i.e., C-shaped in cross section, housing 104 surrounds rod 96 and includes an opening 106 along its length. The opening 106 defines upper and lower edges of display elements 80*a*–80*i* and includes formations, described hereafter, for retention of gel strips 24 adjacent the rod 96. Light escaping rod 96 by way of opening 106 passes through the gel strips 24 to provide the desired color indicia.

Figure 6:
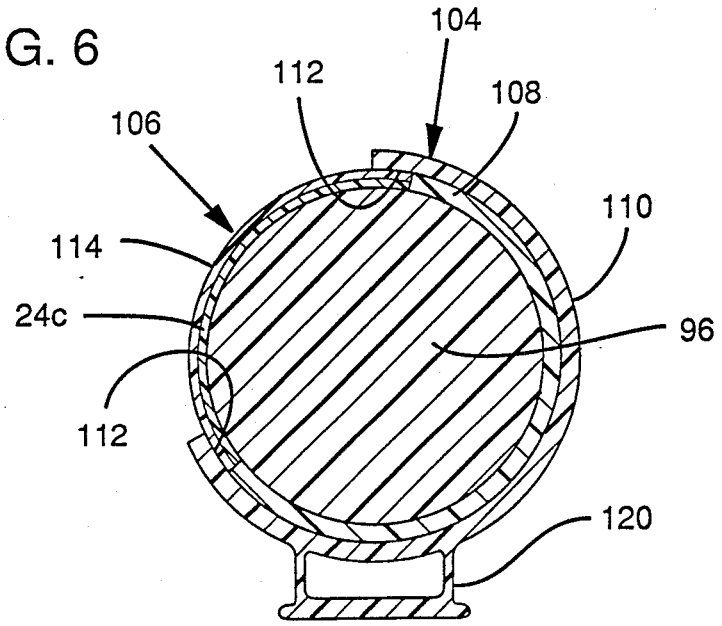
FIG. 6 is a cross sectional view of the color display of FIG. 5 taken along lines 6—6 of FIG. 5.

With reference to FIG. 6 in conjunction with FIG. 5, the housing 104 comprises an inner semi-tubular element 108 and an outer semi-tubular element 110, both concentric to rod 96. The outer semi-tubular element 110 includes an opening along its length defining the opening 106. The inner semi-tubular element 108 includes an opening similar to that of the element 110 but occupying a larger angular portion, as viewed in cross section, of the element 108. Upper and lower gel strip retention spaces 112 are formed in the region between outer semi-tubular element 110 and rod 96 but unobstructed by inner semi-tubular element 108. As shown in FIG. 6, a gel strip 24 lies along the surface portion of rod 96 exposed by opening 106, its upper and lower edges positioned within upper and lower retention spaces 112, respectively. A transparent cover sheet 114 lies on top of gel strips 24 with its upper and lower edges also held within upper and lower retention spaces 112, respectively. The cover sheet 114 includes light impervious bars 116 (FIG. 5) defining borders between individual display elements 80*a*–80*i*.

To mount gel strips 24 within the respective display elements 80*a*–80*i*, the lower edge of cover sheet !14 is placed in the lower retention space 112. Selected gel strips 24 are then aligned with respect to bars 116 behind the cover sheet 114 with their lower edges inserted in the lower retention space 112 between the sheet 114 and rod 96. When the selected gel strips 24 are suitably aligned with respect to the bars 116 of sheet 114, the upper edges of the gel strips 24 and the cover sheet 114 are inserted within the upper retention space 112. Gel strips 24 are then held against the rod 96. When light is injected into rod 96 from light source 86, the light escapes rod 96 by way of opening 106. Gel strips 24 filter the escaping light and provide the desired color indicia.

A mounting strip 120 attaches to the bottom of housing 104 and provides a stable base for placing display 80 upon console 81. Mounting strip 120 may include fastening means, e.g., a magnetic element or adhesive, for attachment to console 81. Display 80 is placed adjacent the faders 16 with each display element 80*a*–80*h* positioned adjacent a corresponding fader 16*a*–16*i*. An operator of console 81 adjusts the output of light source 86 by adjusting knob 90 and views display 80 to determine the color of stage lights 14 associated with each fader 16. Shield 82 may be provided with an opening 122 permitting escape of some light from source 86 onto the controls of console 81 to aid in manipulation of faders 16. Also, additional light may be provided on the console 81 by, for example, a display panel 80*j* having no gel strip 24 mounted therein.

Thus a display for a lighting control console has been shown and described. The display provides color indica for quickly associating a lighting control console fader with a colored stage light. An operator is able to determine immediately the color of the corresponding stage light without resorting to use of crowded written notation on adhesive tape placed next to the faders. The display provides and attractive addition to lighting control consoles with its multi-colored display elements. Each display element may be adapted to use the same filter material as is used on the corresponding stage light. A precise representation of the light available from that stage light is provided to the operator of the control console.

While a preferred embodiment of the present invention has been shown and described, it will be apparent to those skilled in the art that many changes and modifications may be made without departing from the invention in its broader aspects. For example, the subject of the present invention is applicable to lighting control consoles having any number of faders, indeed the larger the number of faders the greater the benefit provided by the present invention. Also, while the present invention has been illustrated using a light source to pass light through a filter element, the present invention can be practiced without the light source by using a variety of colored display elements. The invention has been shown with displays positioned adjacent the faders, but the scope of the invention includes other display arrangements, such as placing colored displays on the fader rather than adjacent the fader. Furthermore, the second illustrated embodiment of the present invention is shown with a single light source, but multiple light sources and a control circuit similar to the circuit of FIG. 3 can be used in such embodiment. The appended claims are therefore intended to cover all such changes and modifications as fall within the true spirit and scope of the invention.

I claim:

1. A display for a stage lighting control console, the console including at least one light control device adapted for controlling an associated colored stage light, the display comprising:

a mounting structure positionable relative to the light control device of the console;

means coupled to said mounting structure for retaining a display element corresponding in color to the stage light and for positioning the display element adjacent the light control device;

means for receiving a light source to illuminate the display element.

2. A display according to claim 1 wherein said console includes a plurality of light control devices each adapted for controlling an associated one of a plurality of colored stage lights, and said display further comprises means for retaining a plurality of display elements each corresponding in color to a selected one of said plurality of colored stage lights and for positioning each display element adjacent the light control device associated therewith.

3. A display according to claim 1 wherein the lighting control console includes a plurality of light control devices lying in a given spaced relation, and said display further comprises means for retaining a plurality of colored elements in spaced relation corresponding to the spaced relation of said light control devices.

4. A display according to claim 1 wherein said retaining means is adapted to received a filter element corresponding to a filter element of the stage light.

5. A display according to claim 1 wherein said display further comprises:

additional retention means adapted to receive a plurality of filter elements; and wherein the means for receiving the light source comprises means for directing light through at least one color filtering element.

6. A display for a stage lighting control console, the control console including a plurality of light control devices lying in a given spaced relation, the display comprising:

a mounting structure attachable to the console in position relative to said light control devices;

attaching means for removably attaching to said mounting structure a plurality of selective color filtering elements in spaced relation corresponding to the spaced relation of said light control devices whereby a selected color filtering element may be positioned adjacent a selected light control device; and a light source for directing light through at least one color filtering element.

7. A display according to claim 6 wherein said attaching means comprises means for receiving selective color filtering elements.

8. A display according to claim 6 wherein said attaching means comprises means for receiving a plurality of selective color filtering elements, and said display further comprises:

coupling means adapted for connection to the light source; and a light conductive element connected to said coupling means for carrying light received from the light source, the light conductive element being positioned relative to said attaching means whereby light passing from said light conductive element passes through each of said selective color filtering elements.

9. A display according to claim 6 wherein said mounting structure comprises a frame for coupling to the lighting control console, each of said color filtering elements comprises a gel strip, and said attaching means comprises a plurality of gel strip retention formations for receiving and retaining selected gel strips therein.

10. A display according to claim 6 wherein said mounting structure comprises a frame for coupling to the lighting control console, said attaching means comprises a plurality of gel strip retention formations for receiving and retaining selected gel strips therein, and said display further comprises a plurality of light sources corresponding to said plurality of gel strip retention formations for passing light through gel strips mounted therein.

11. A stage lighting control system comprising:

a stage lighting control console adapted for operative coupling to a plurality of colored stage lights, said stage lighting control console including a plurality of light control devices for independent operation of said stage lights; and means for removably receiving a plurality colored display elements whereby a selected display element may be positioned adjacent a selected light control device;

wherein said console includes at least one light source for directing light through at least one of said selective color filter elements.

12. A display according to claim 11 wherein said receiving means is adapted to receive as said colored display elements a plurality of selective color filter elements corresponding to color filter elements used on stage lights controlled by said light control devices.

13. A method of displaying stage lighting on a lighting control console having a plurality of light control devices each adapted for controlling an associated one of a plurality colored stage lights, the method comprising:

providing a plurality of colored display elements each corresponding in color to one of the colored stage lights, and a light source to illuminate at least one of the colored display elements;

positioning selected colored display elements in positions relative to said light control devices whereby display elements are associated with light control devices, the color of each display element corresponding to the color of the stage light controlled by the associated light control device; and illuminating at least one of the colored display elements with the light source.

14. A method according to claim 13 wherein the providing step comprises providing colored display elements comprising selective color filtering elements; and wherein the illuminating step comprises directing light from the light source through at least one of said selective color filtering elements.

* * * * *